US006602081B1

(12) United States Patent
Wang

(10) Patent No.: US 6,602,081 B1
(45) Date of Patent: Aug. 5, 2003

(54) SHIELDING CAP AND ELECTRIC SOCKET ARRANGEMENT

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/190,673

(22) Filed: Jul. 9, 2002

(51) Int. Cl.[7] ..... H01R 13/44
(52) U.S. Cl. ..... 439/145; 439/137
(58) Field of Search ..... 439/135–145, 439/652, 654

(56) References Cited

U.S. PATENT DOCUMENTS 5,997,318 A * 12/1999 Chou ..... 439/136
6,305,956 B1 * 10/2001 Deng ..... 439/138
6,406,308 B1 * 6/2002 Wang ..... 439/145

* cited by examiner

*Primary Examiner*—Lynn Feild
*Assistant Examiner*—Son V. Nguyen
(74) *Attorney, Agent, or Firm*—Rosenberg, Klein & Lee

(57) ABSTRACT

A shielding cap and electric socket -arrangement is constructed to include an electric socket integral with a part of an electric outlet, the electric socket having two parallel sliding rails disposed at two sides of plugholes thereof, a shielding cap movable along the parallel sliding rails between a first position to close the plugholes of the electric socket and a second position to open the plugholes of the electric socket, and a lock structure provided between the shielding cap and the electric socket and adapted for selectively locking the shielding cap between the first position and the second position.

3 Claims, 14 Drawing Sheets

SHIELDING CAP AND ELECTRIC SOCKET ARRANGEMENT

BACKGROUND OF THF INVENTION

1. Field of the Invention

The present invention relates to electric outlets and, more specifically, to a shielding cap and electric socket arrangement, which enables the shielding cap to be shifted between close and open position and locked in the close position.

2. Description of the Related Art

FIG. 1 illustrates a conventional electric extension cable in which a shielding cap 12 is used and fastened to the electric outlet 1 to close one electric socket 11, preventing insertion of external objects into the electric socket 11 by a child. When in use, the user must remove the respective shielding cap 12 from the respective electric socket 11 so that the electric plug can be inserted into the selected electric socket 11 of the electric outlet 1. After removable of the shielding cap 12 from the corresponding electric socket 11 of electric outlet 1, the shielding cap 12 must be properly received. Because the shielding cap 12 is a small item, it tends to be lost somewhere after removal from the electric outlet 1. Further, it is inconvenient to mount and dismount the shielding cap 12 frequently.

In order to eliminate the aforesaid drawbacks, various safety electric outlets have been disclosed. These safety electric outlets have a safety structure on the inside, which prevents direct contact of inserted external object(s) with the internal electric contacts. When using these electric outlets, a supplementary device, for example, a push rod, plug pin, spring, etc., is used with the inserted electric plug to open the passage between the plugholes and the corresponding electric contacts in the electric socket, enabling the metal blades of the electric plug to be set into contact with the respective electric contacts in the socket to close the circuit. Similar designs are seen in publication nos. 360443; 403247; 361714; 331986; 323852; 296125; 286831; 196026; 190251; 356969; and etc. However, providing a safety structure in an electric socket must change the positioning or structure of the original electric contacts in the electric socket. Further, the installation of the safety structure complicates the fabrication of the electric socket and, may increase the dimensions of the electric socket.

FIG. 2 illustrates the use of shielding caps 22 in an electric outlet 2 to close/open each three-pole electric socket 21 of the electric outlet 2. As illustrated, each electric socket 21 of the electric outlet 2 has a top recess 23. The shielding cap 22 can be moved horizontally in the top recess 23 of the corresponding electric socket 21 between two positions to close/open the corresponding electric socket 21. This design still has drawbacks. From the outer appearance, one cannot quickly recognize the "on" or "off" positioning of each shielding cap 22, and the user may neglect shifting the shielding cap 22 to the close position when the corresponding electric socket 21 not in use. Further, when the shielding cap 22 shifted to the close position, it tends to be forced out of the close position upon an impact because there is no means to lock the shielding cap 22 in the close position.

SUMMARY OF THF INVENTION

The present invention has been accomplished to provide a shielding cap and electric socket arrangement, which eliminates the aforesaid problems. It is one object of the present invention to provide a shielding cap and electric socket arrangement, which can easily and positively be installed in an electric outlet and moved between two positions to close/open the corresponding electric socket. It is another object of the present invention to provide a shielding cap and electric socket arrangement, which has means to lock the shielding cap in the close position. It is still another object of the present invention to provide a shielding cap and electric socket arrangement, which causes a sense of beauty when installed. It is still another object of the present invention to provide shielding cap and electric socket arrangement, which is practical for use in a floor type electric outlet as well as a wall type electric outlet. To achieve these and other objects of the present invention, the shielding cap and electric socket arrangement comprises an electric socket integral with a part of an electric outlet, the electric socket comprising two parallel sliding rails disposed at two sides of plugholes thereof; a shielding cap movable along the parallel sliding rails between a close position to close the plugholes of the electric socket and an open position to open the plugholes of the electric socket; and a lock structure is provided between the shielding cap and the electric socket and adapted for selectively locking the shielding cap between the close position and said open position. The locking structure may be variously embodied by means of the application of known techniques.

DETAILED DESCRIPTION OF THE PREFERRED EMBODIMENT

Figure 1:
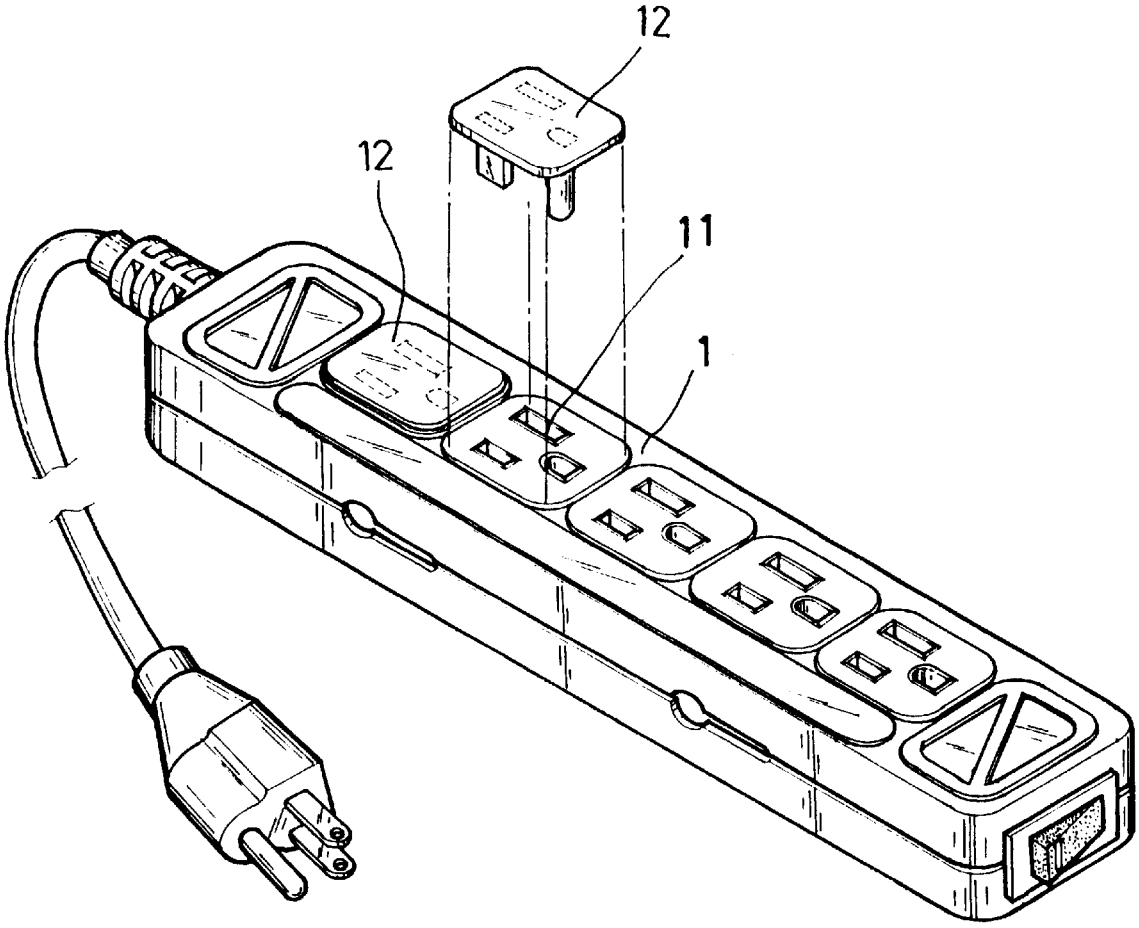
FIG.1 PRIOR ART
FIG. 1 is an exploded view of an electric outlet showing one design of shielding cap and electric socket arrangement according to the prior art.
Figure 2:
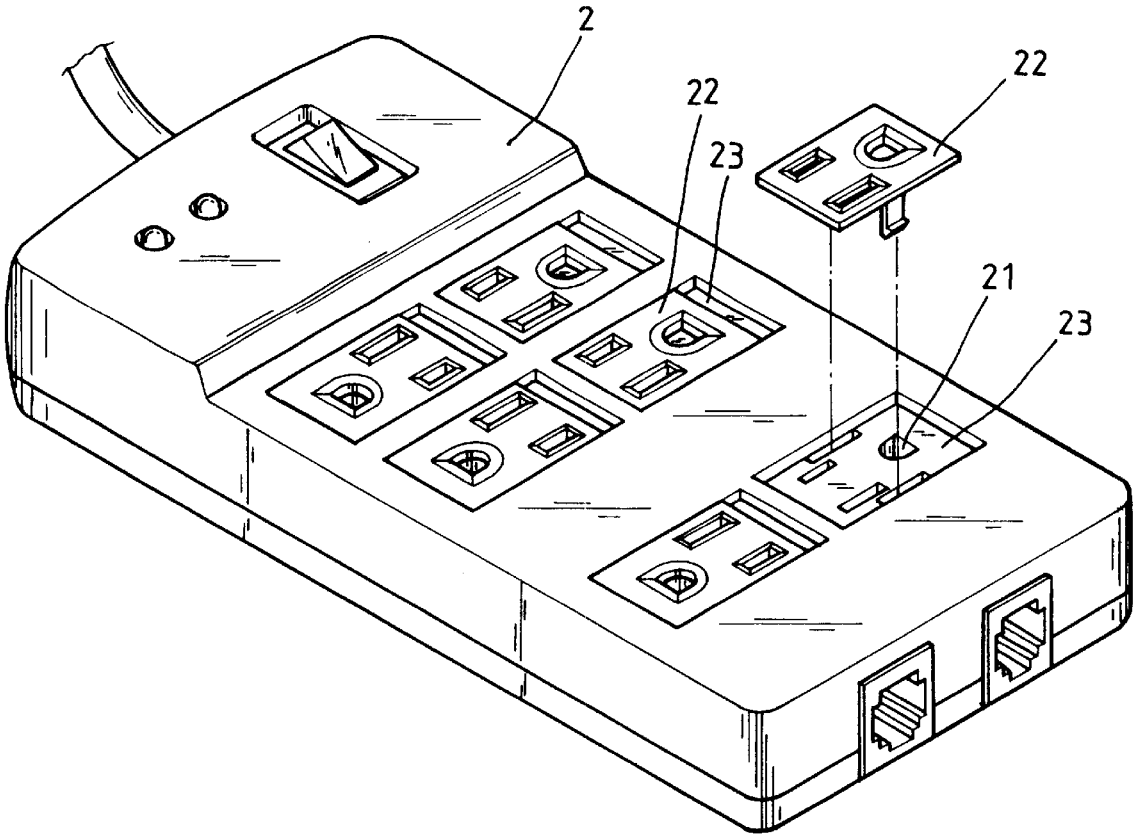
FIG. 2 PRIOR ART
FIG. 2 is an exploded view of an electric outlet showing another design of shielding cap and electric socket arrangement according to the prior art.
Figure 3:
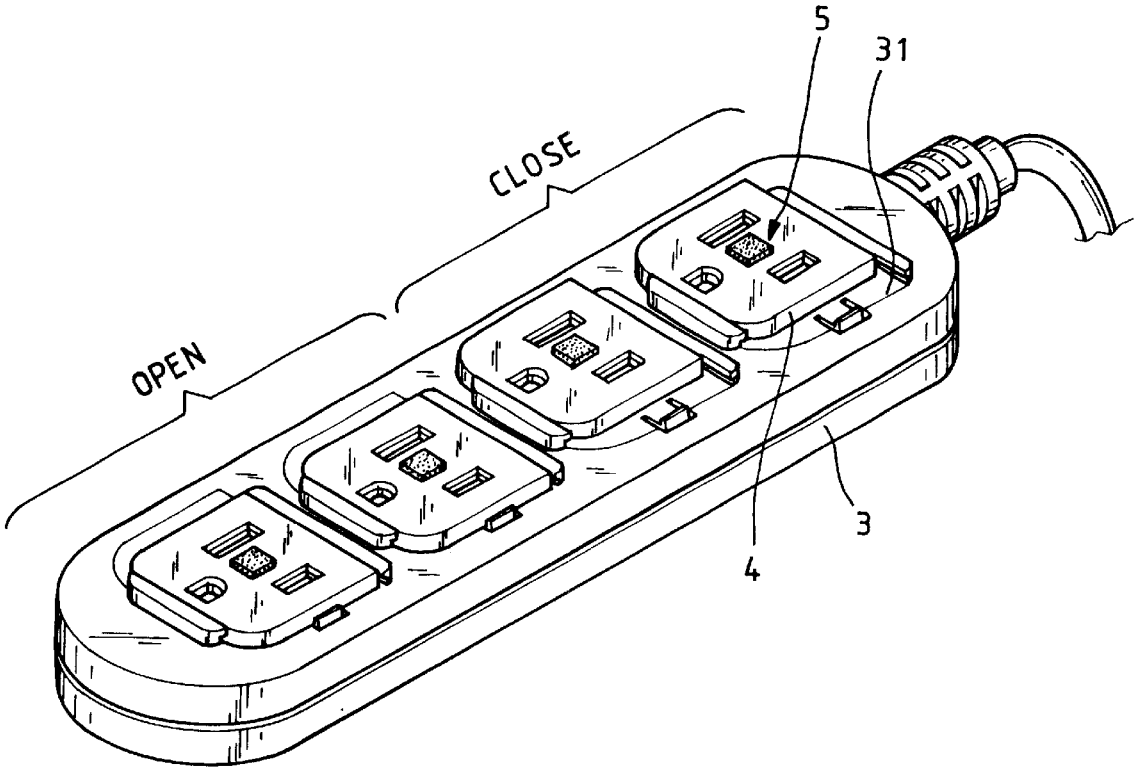
FIG. 3 is an elevational view of an electric outlet showing a shielding cap and electric socket arrangement according to the present invention.

Referring to FIGS. from 3 through 8, a shielding cap and electric socket arrangement in accordance with the present invention is shown comprised of an electric socket 31 integral with an electric outlet 3, a shielding cap 4 adapted for closing the electric socket 31, and a lock 5 adapted for locking the shielding cap 4 in the close position.

Figure 4:
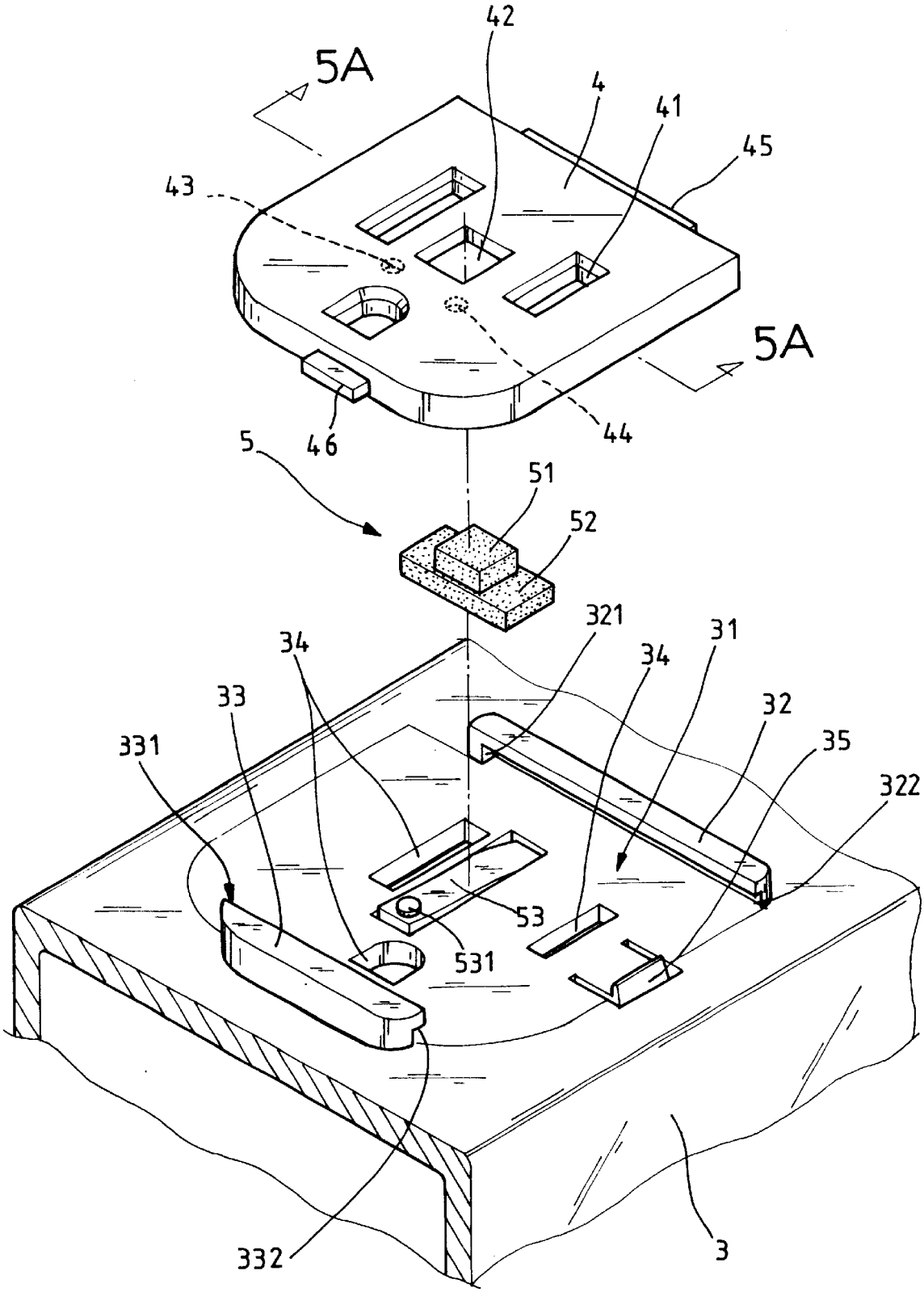
FIG. 4 is an exploded view in an enlarged scale of a part of FIG. 3.

Referring to FIG. 4 again, the electric socket 31 comprises a set of (two or three) plugholes 34 adapted for receiving the blades (or the blades and grounding prong) of an electric plug, two parallel sliding rails 32;33 protruded from the top sidewall thereof at two sides of the plugholes 34 and adapted for guiding movement of the shielding cap 4 between two positions to close/open the plugholes 34 (the sliding rails 32;33 are shaped like an angle bar defining a longitudinal path therebetween above the top sidewall of the electric socket 31).

Referring to FIG. 4 again, the shielding cap 4 is coupled to the electric socket 31 and moved along the sliding rails 32;33 between the close position and the open position to close/open the plugholes 34, having a set of insertion holes 41 extended through the top and bottom sidewalls thereof corresponding to the plugholes 34 of the electric socket 31. When shifted to the open position, the insertion holes 41 of the shielding cap 4 are respectively aimed at the plugholes 34 of the electric socket 31. The shielding cap 4 further comprises a stepped center hole 42 extended through the top and bottom sidewalls at the center, two lock holes 43;44 formed in the bottom sidewall. The stepped center hole 42 has a relatively narrower upper section and a relatively broader lower section.

Figure 5A:
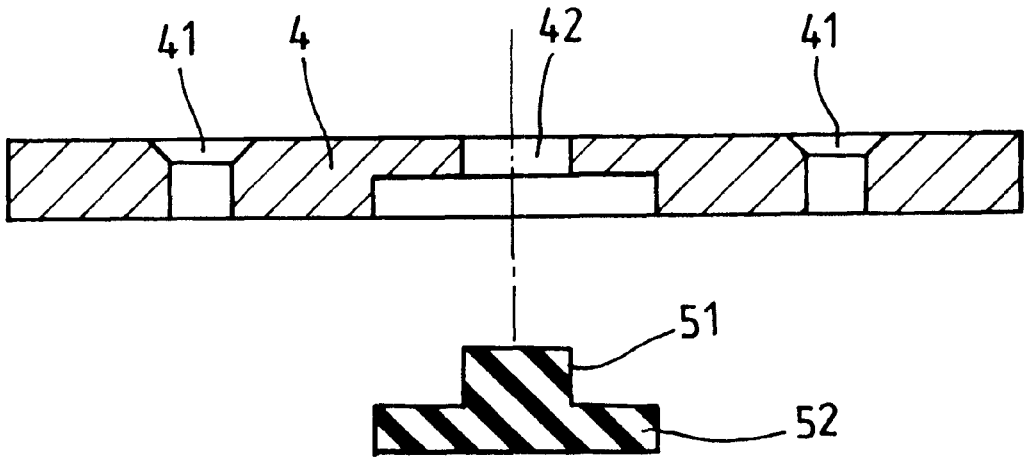
FIG. 5A is a sectional view taken along line 5A—5A of FIG. 4.
Figure 5B:
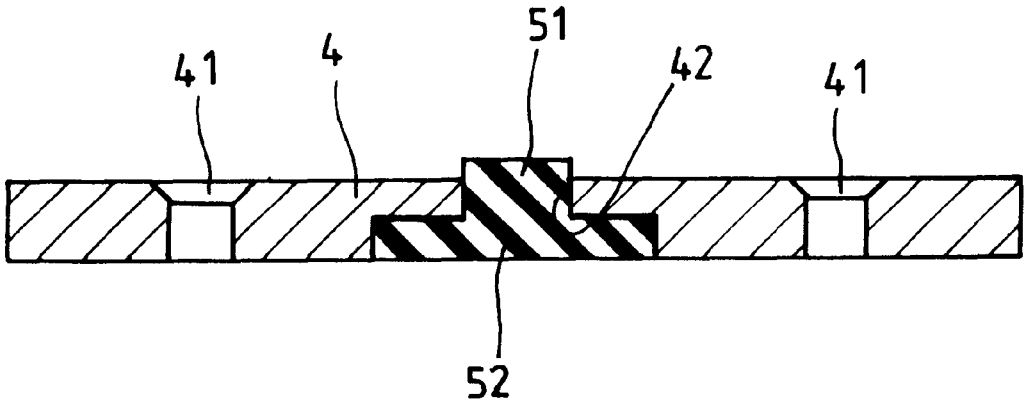
FIG. 5B is a sectional assembly view of FIG. 5A.
Figure 6:
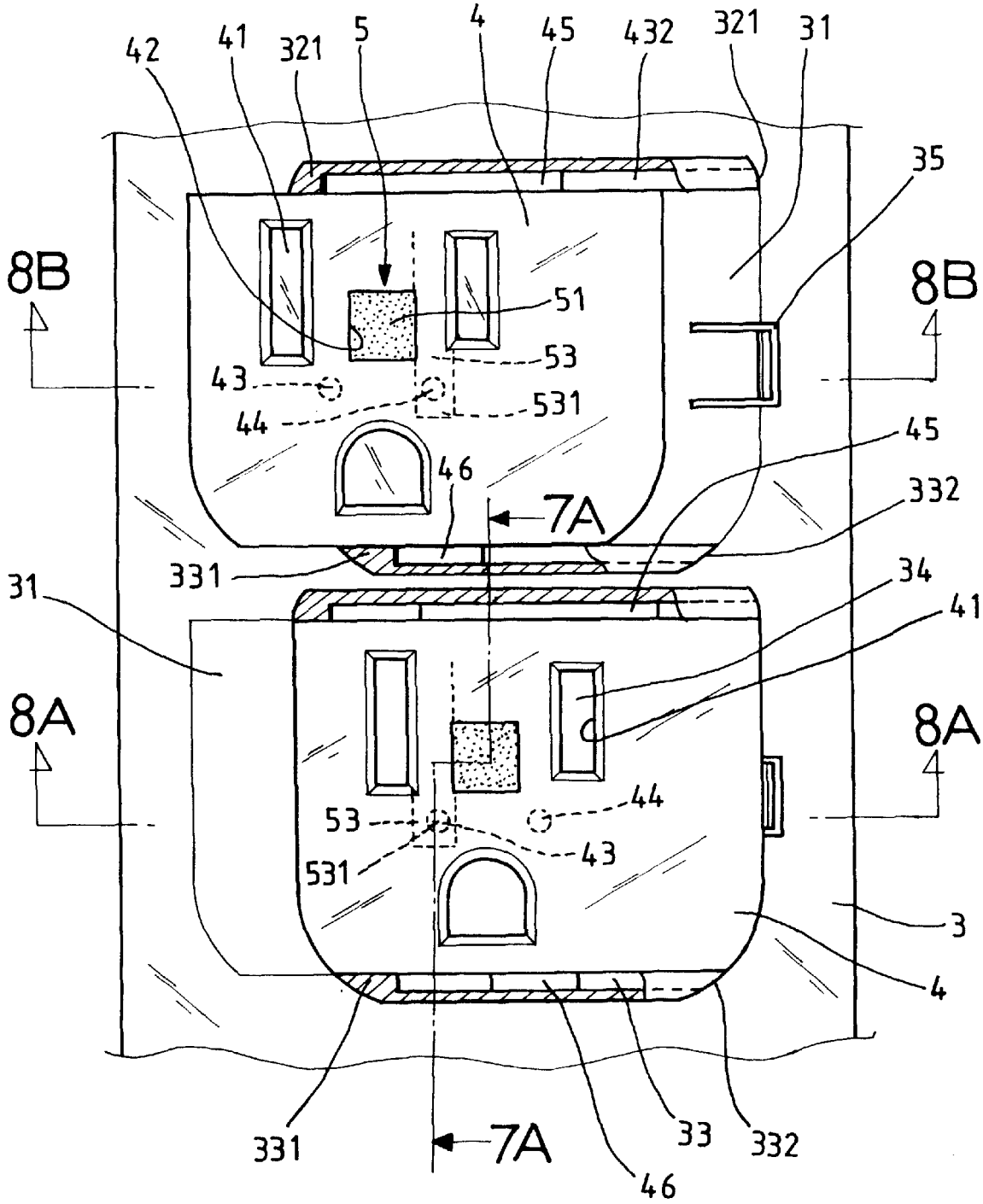
FIG. 6 is a top plain view in an enlarged scale of a part of FIG. 3.
Figure 7A:
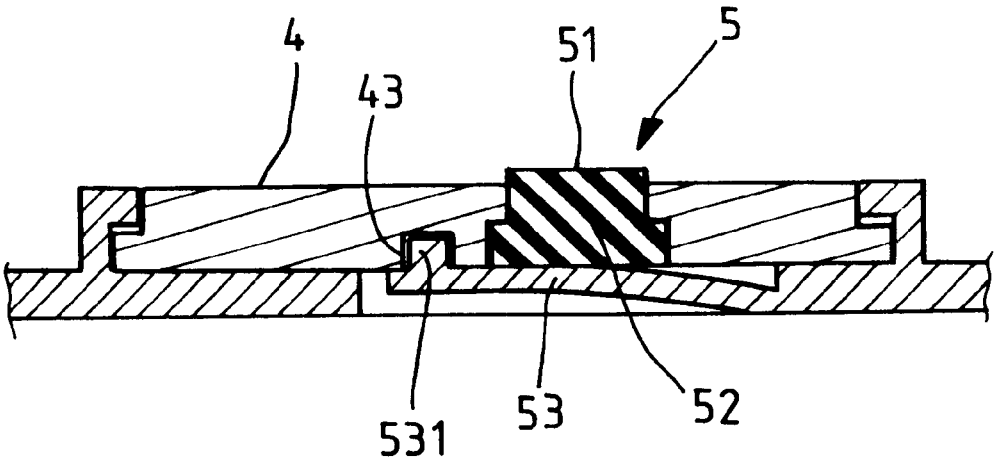
FIG. 7A is a sectional view taken along line 7A—7A of FIG. 6.
Figure 7B:
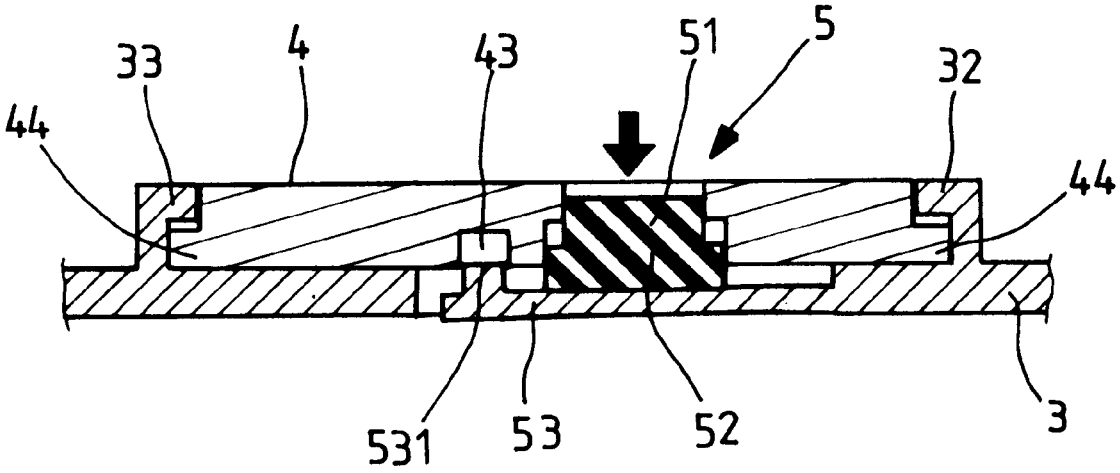
FIG. 7B is similar to FIG. 7A but showing the lock unlocked.

Referring to FIGS. 4, 5A and 5B again, the lock 5 comprises a stepped actuating member 51, and a springy locking plate 53. The springy locking plate 51 has a fixed end fixedly connected to a part of the electric socket 31, and a free end provided with an upwardly protruded retaining portion 531 adapted for selectively locking the shielding cap 4 in the close or open position stepped. The stepped actuating member 51 is mounted in a stepped center hole 42 of the shielding cap 4 above the springy locking plate 53 and partially protruding over the top sidewall of the shielding cap 4, having an expanded base 52 disposed in contact with a middle part of the springy locking plate 53.

Figure 8A:
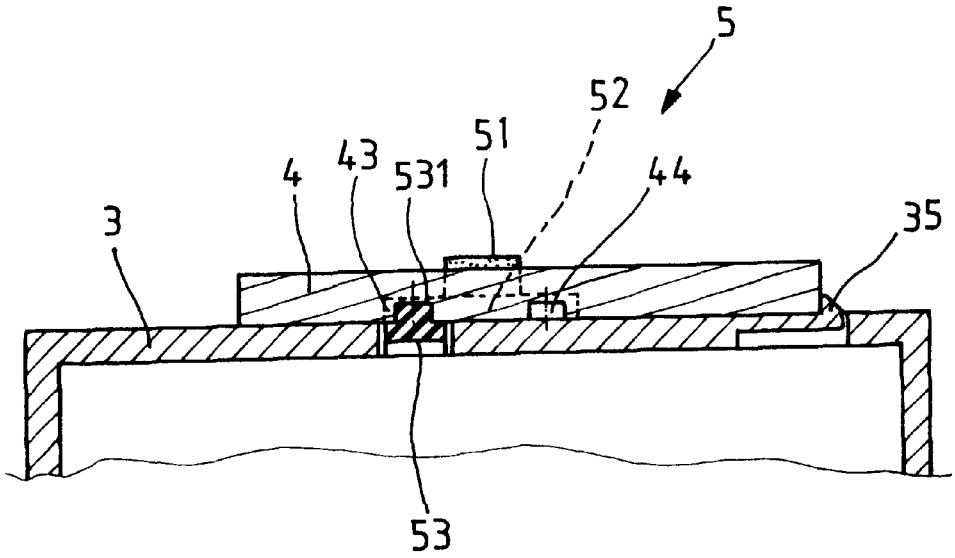
FIG. 8A is a sectional view taken along line 8A—8A of FIG. 6.
Figure 8B:
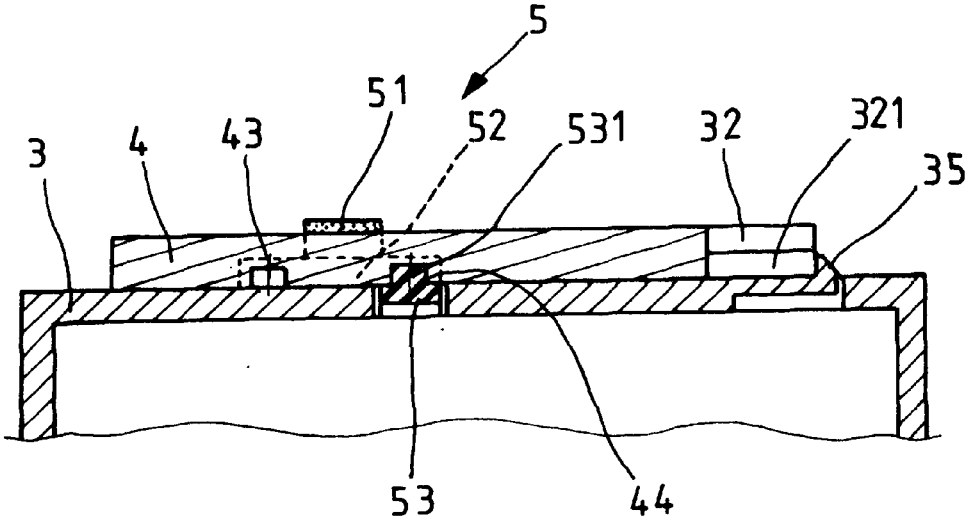
FIG. 8B is a sectional view taken along line 8B—8B of FIG. 6.
Figure 9:
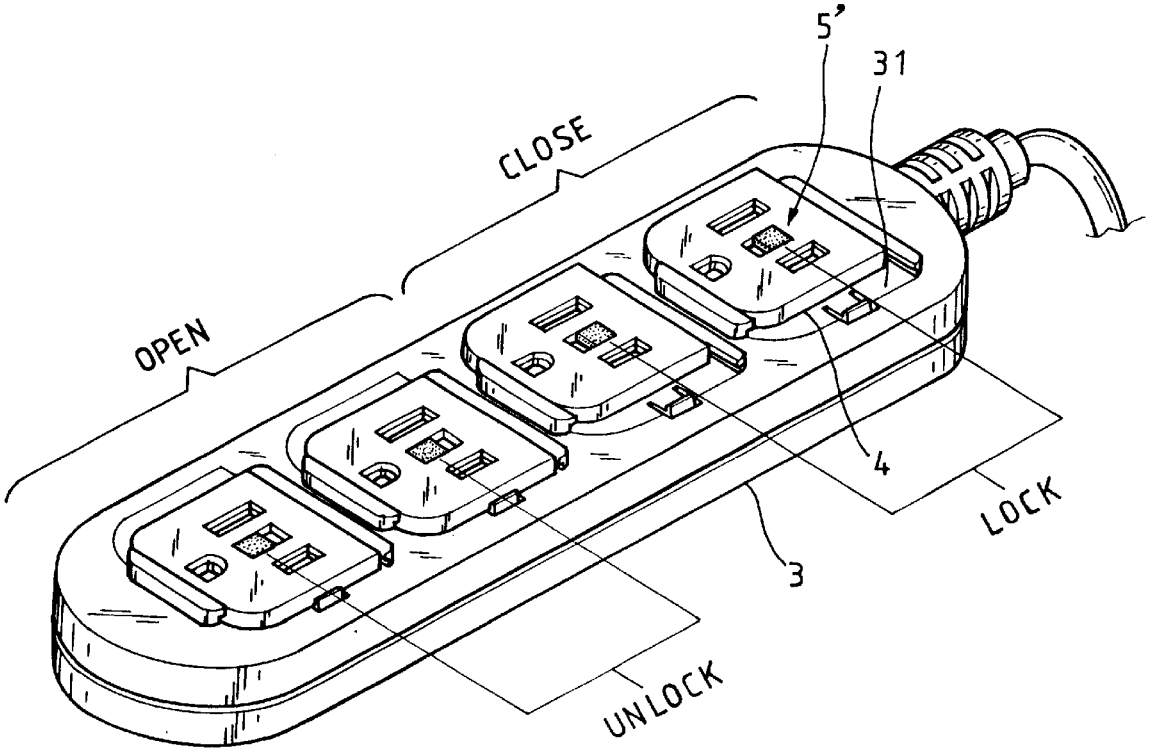
FIG. 9 is an elevational view of an electric outlet showing an alternate form of the shielding cap and electric socket arrangement according to the present invention.
Figure 10:
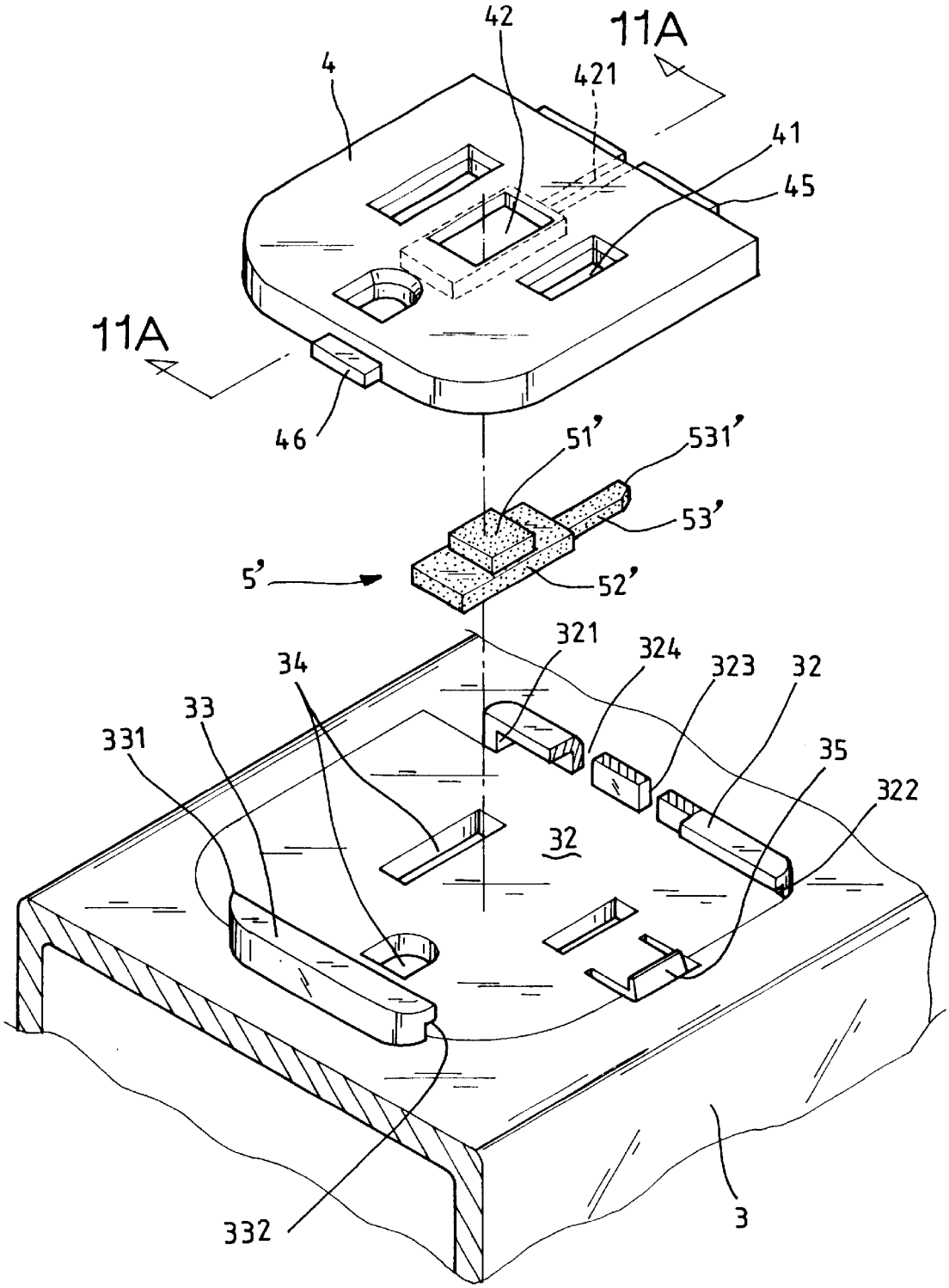
FIG. 10 is an exploded view in an enlarged scale of a part of FIG. 9.
Figure 11A:
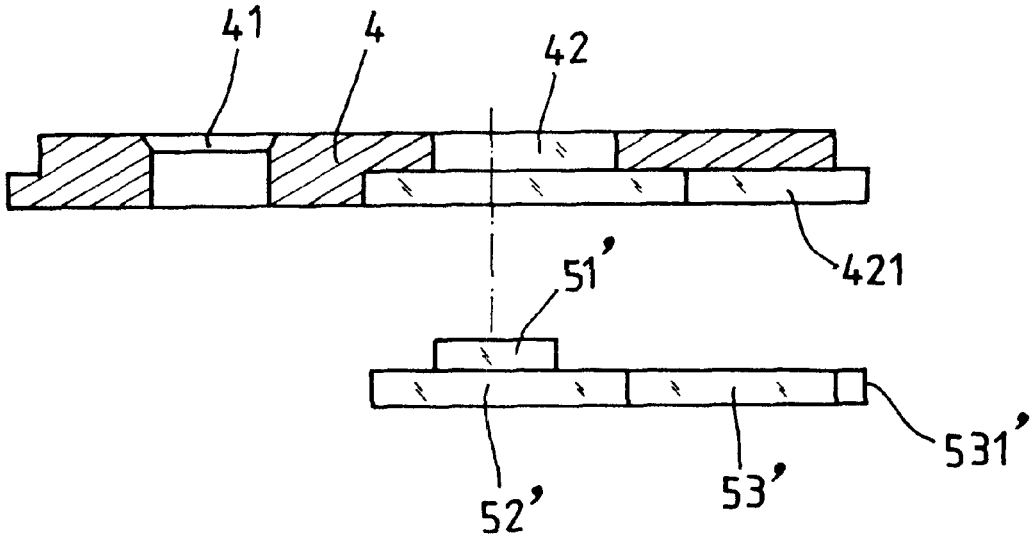
FIG. 11A is a sectional view taken along line 11A—11A of FIG. 10.
Figure 11B:
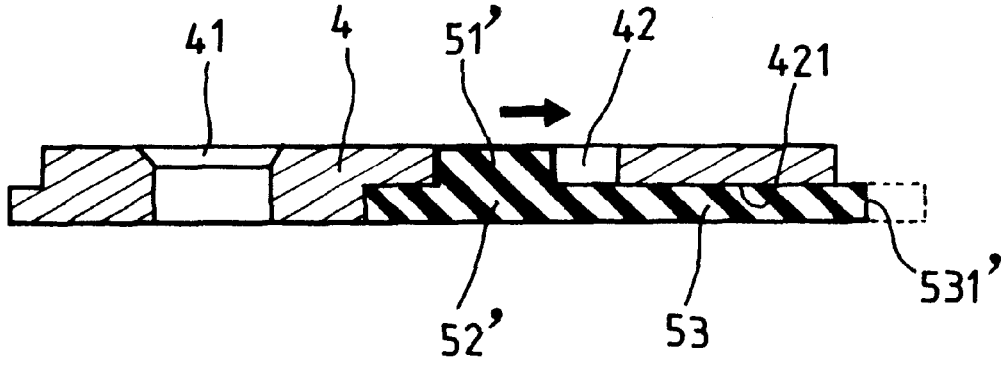
FIG. 11B is a sectional assembly view of FIG. 11A.
Figure 12:
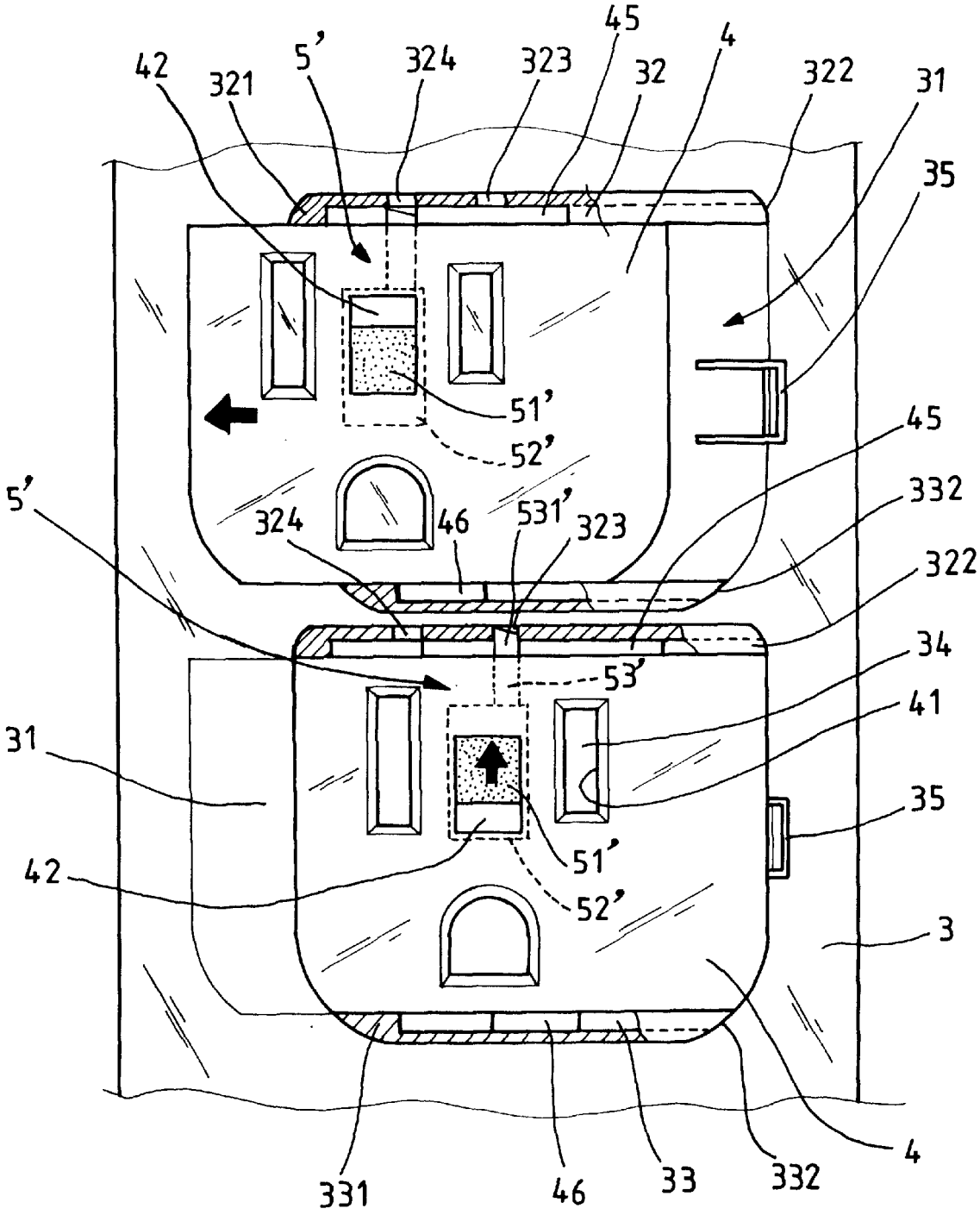
FIG. 12 is a top plain view in an enlarged scale of a part of FIG. 9.

Referring to FIGS. 6, 7A, 7B, 8A and 8B again, the springy locking plate 51 partially protrudes over the top sidewall of the shielding cap 4. When pressed the stepped actuating member 51 downwards against the springy locking plate 53, the springy locking plate 53 is lowered to disengage the upwardly protruded retaining portion 531 from the shielding cap 4, for enabling the shielding cap 4 to be moved along the sliding rails 32;33 between the close position and the open position. When the user released the hand from the stepped actuating member 51 after the shielding cap 4 has been shifted to the close position, the springy locking plate 53 returns to its former shape (due to the effect of the spring power of its material property), thereby causing the upwardly protruded retaining portion 531 to be engaged into the second lock hole 44 of the shielding cap 4 to lock the shielding cap 4 in the close position (see FIG. 8B). On the contrary, when the user released the hand from the stepped actuating member 51 after the shielding cap 4 has been shifted from the close position to the open position, the springy locking plate 53 returns to its former shape, thereby causing the upwardly protruded retaining portion 531 to be engaged into the first lock hole 43 of the shielding cap 4 to lock the shielding cap 4 in the open position (see FIG. 8A).

Referring to FIG. 4 again, the sliding rails 32 each have a front close end 321 or 331, and a rear open end 322 or 332. Through the rear open ends 322;332, the shielding cap 4 is inserted into the sliding path between the sliding rails 32;33 above the top sidewall of the electric socket 31. The shielding cap 4 comprises two guide flanges 45;46 respectively protruded from two opposite vertical peripheral sidewalls thereof and respectively coupled to the sliding rails 32;33 for guiding movement of the shielding cap 4 along the sliding rails 32;33. Further, a spring stop member 35 is integral with the top sidewall of the electric socket 31 between the rear open ends 322;332 of the sliding rails 32. When inserting the shielding cap 4 into the rear open ends 322;332 of the sliding rails 32, the spring stop member 35 is forced downward for enabling the shield cap 4 to pass. After the shielding cap 4 has been inserted into the sliding path between the sliding rails 32;33, the spring stop member 35 immediately returns to its former shape to stop the shielding cap 4 in between the sliding rails 32;33, preventing the shielding cap 4 from falling out of the electric socket 31.

As indicated above, the shielding cap 4 can be moved along the sliding rails 32;33 of the electric socket 31 between the close position and the open position to close/open the plugholes 34 of the electric socket 31. When the shielding cap 4 shifted to the close position, the lock 5 locks the shielding cap 4 in the close position, preventing a child from touching the internal electric circuit of the electric socket 31 with a foreign metal object.

FIGS. 9~12 show an alternate form of the present invention. This alternate form is substantially similar to the aforesaid embodiment with the exception of the structure of the lock. According to this alternate form, the lock 5' comprises a stepped actuating member 51' having an expanded base 52', and a locking bar 53' extended from one side of the expanded base 52' of the stepped actuating member 51' toward one sliding rail, namely, the first sliding rail 32 of the electric socket 31. The locking bar 53' has a beveled front locking end 531'. The shielding cap 41 has a sliding groove 421 disposed in the bottom sidewall thereof and extended from one side of the stepped center hole 42 to one vertical peripheral sidewall across one guide flange 45. The first sliding rail 32 of the electric socket 31 has a first lock hole 323 and a second lock hole 324.

Figure 13:
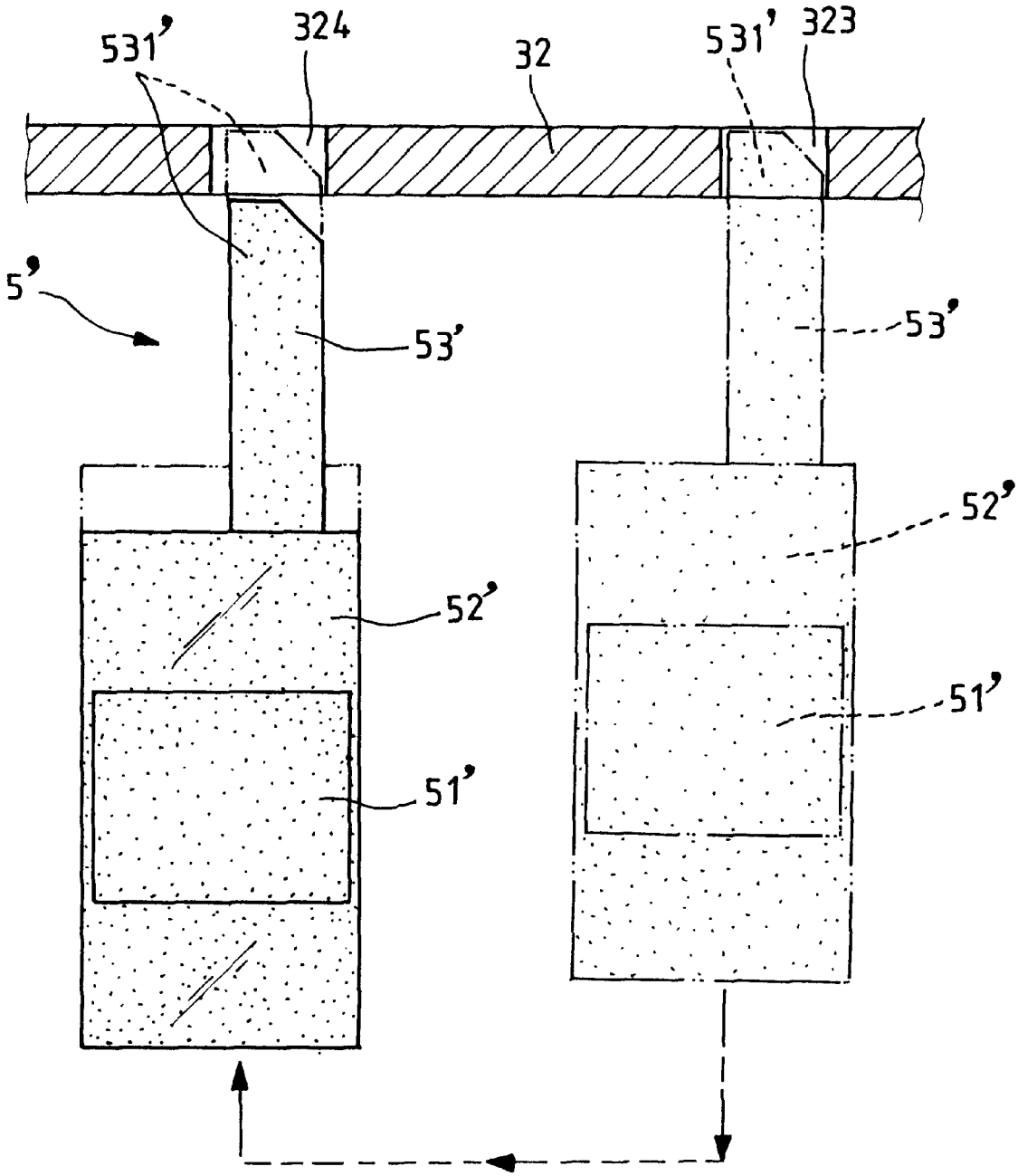
FIG. 13 is a schematic drawing showing the locking action of the alternate form of the shielding cap and electric socket arrangement according to the present invention.
Figure 14:
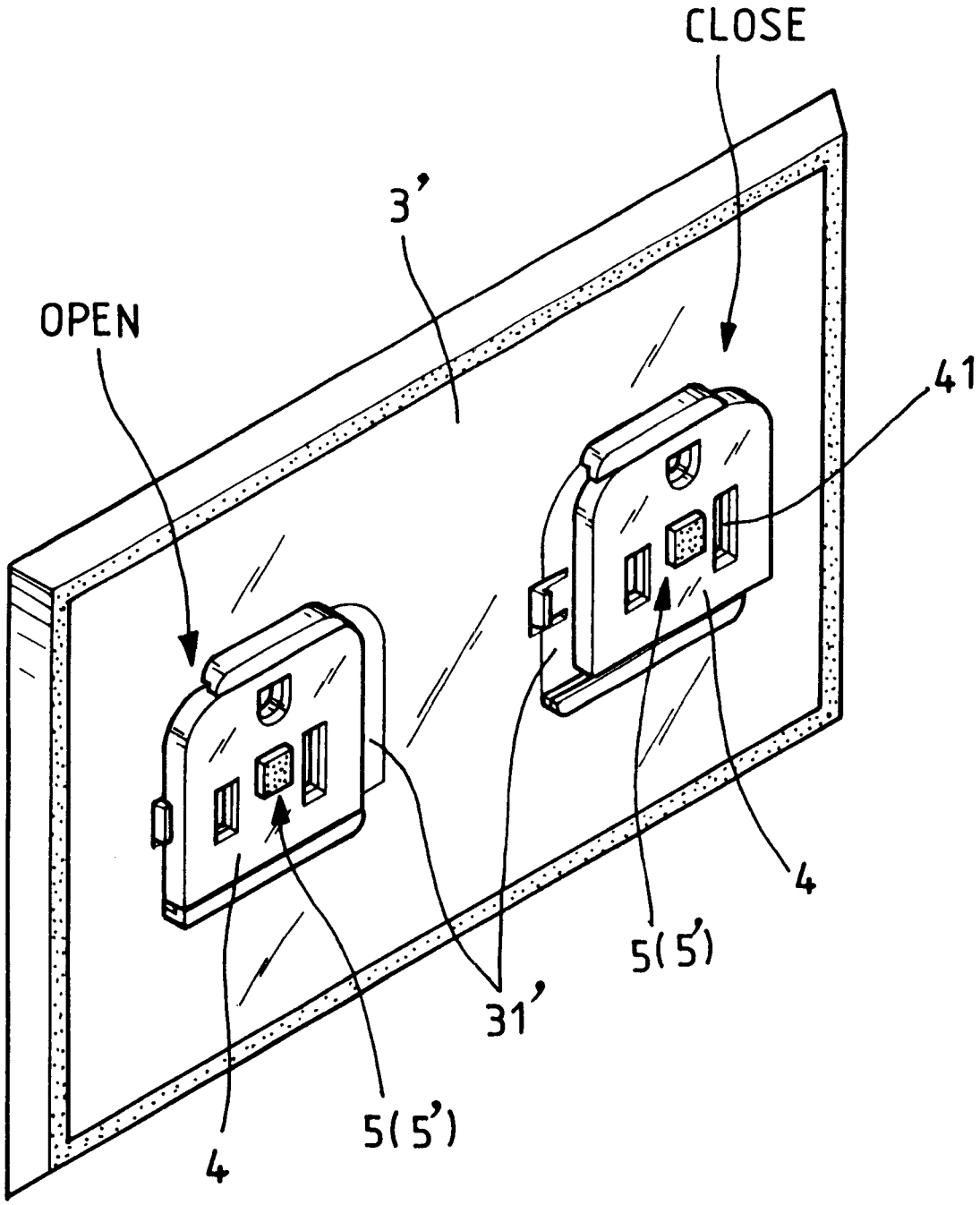
FIG. 14 is an elevational view of a wall type electric outlet embodying the present invention.

Referring to FIG. 13 and FIGS. 11B and 12 again, the stepped actuating member 51' can be moved in the stepped center hole 42 of the shielding cap 41 alternatively forwards and backwards. When the stepped actuating member 51' moved backwards, the locking bar 53' is moved with the stepped actuating member 51' along the sliding groove 421 to disengage the beveled front locking end 531' from the first sliding rail 32, for enabling the shielding cap 4 to be shifted along the sliding rails 32;33 between the close position and the open position. When the shielding cap 4 shifted to the close position, the actuating member 51' is moved forwards from the unlocking position to the locking position to force the beveled front locking end 531' of the locking bar 53' into the second lock hole 324 to lock the shielding cap 4 in the close position. On the contrary, when the shielding cap 4 shifted from the close position to the open position, the actuating member 51' is moved forwards from the unlocking position to the locking position to force the beveled front locking end 531' of the locking bar 53' into the first lock hole 323 to lock the shielding cap 4 in the open position.

According to the aforesaid two embodiments of the present invention, the shielding cap and electric socket arrangement is used in a floor type electric outlet. The shielding cap and electric socket arrangement can also be used in a wall type electric outlet as shown in FIG. 13.

A prototype of shielding cap and electric socket arrangement has been constructed with the features of the annexed drawings of FIGS. 3~14. The shielding cap and electric socket arrangement functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A shielding cap and electric socket arrangement comprising:

an electric socket integral with a part of an electric outlet, said electric socket comprising two parallel sliding rails disposed at two sides of plugholes thereof;

a shielding cap movable along said parallel sliding rails between a close position to close the plugholes of said electric socket and an open position to open the plugholes of said electric socket; and wherein a lock structure is provided between said shielding cap and said electric socket and adapted for selectively locking said shielding cap between said close position and said open position, said locking structure comprising a stepped through hole formed in said shielding cap through top and bottom sidewalls of said shielding cap, a springy locking plate, said springy locking plate having a fixed end fixedly connected to a part of said electric socket and a free end adapted for locking said shielding cap, and a stepped actuating member mounted in said stepped through hole and supported on said springy locking plate for operation by hand to move said springy locking plate between a locking position and an unlocking position.

2. The shielding cap and electric socket arrangement as claimed in claim 1, wherein said locking structure further comprising a first lock hole and a second lock hole in a bottom sidewall thereof; said springy locking plate has a retaining portion protruded from the free end and adapted for engaging into one of said first lock hole and said second lock holes to selectively lock said shielding cap between said close position and said open position.

3. A shielding cap and electric socket arrangement comprising:

an electric socket integral with a part of an electric outlet, said electric socket comprising two parallel sliding rails disposed at two sides of plugholes thereof;

a shielding cap movable along said parallel sliding rails between a close position to close the plugholes of said electric socket and an open position to open the plugholes of said electric socket; and wherein a lock structure is provided between said shielding cap and said electric socket and adapted for selectively locking said shielding cap between said first position and said second position, said locking structure comprising a sliding hole formed in said shielding cap, two lock holes formed in one of said sliding rails of said electric socket, a stepped actuating member movable in said sliding hole between a locking position and an unlocking position, and a fixed locking bar extended from one side of said stepped actuating member and adapted for selectively engaging into said lock holes to lock said shielding cap between said close position and said open position.

* * * * *